United States Patent [19]

Colver

[11] Patent Number: 4,876,497

[45] Date of Patent: Oct. 24, 1989

[54] POWER FACTOR CORRECTOR

[75] Inventor: Frank Colver, Costa Mesa, Calif.

[73] Assignee: HC Power, Inc., Santa Ana, Calif.

[21] Appl. No.: 247,039

[22] Filed: Sep. 20, 1988

[51] Int. Cl.[4] ..... G05F 1/70

[52] U.S. Cl. ..... 323/211; 323/222; 323/319

[58] Field of Search ..... 363/126; 323/205, 209, 323/210, 211, 222, 235, 319

[56] References Cited

U.S. PATENT DOCUMENTS

| | | | |
|---|---|---|---|
| 4,193,111 | 3/1980 | Wester | 323/211 X |
| 4,384,321 | 5/1983 | Rippel | 323/222 X |
| 4,683,529 | 7/1987 | Bucher, II | 323/207 X |
| 4,688,162 | 8/1987 | Hutch et al. | 323/222 X |

FOREIGN PATENT DOCUMENTS

| | | | |
|---|---|---|---|
| 0169673 | 1/1986 | European Pat. Off. | 323/205 |

*Primary Examiner*—Peter S. Wong

*Assistant Examiner*—Kristine Peckman

*Attorney, Agent, or Firm*—Stetina and Brunda

[57] ABSTRACT

A method and apparatus are disclosed for correcting the power factor of an input alternating current signal. The invention is adapted to generating an AC output signal connectable to one or more loads, such as capacitive loads. The circuit includes an energy storage inductor connected in series between the input and output terminals. A short circuit path is provided to connect output terminals during a portion of each half cycle of the AC input voltage waveform. The portion corresponds to the time necessary for the inductor to reach a level substantially corresponding to the peak level of current through the inductor when the short circuit path is disabled. In the preferred embodiment the enablement of the short circuit path between ouput terminals commences at the time the input voltage waveform crosses the zero reference value, and ends at a time at which the AC output voltage exceeds the input voltage.

15 Claims, 2 Drawing Sheets

START
0 V
+10V

AC OUTPUT VOLTAGE (– – –)
AC INPUT VOLTAGE (———)
R1
R2
R3
R4
0 V

P1
P2
AC INPUT CURRENT
0 I
ACTIVE
PASSIVE

AC OUTPUT CURRENT
0 I

PEAK HOLD AMPLIFIER OUTPUT
0 V

DRIVE
ON
OFF
+10V
0V–

RESET
ON
OFF
+10V
0V–

POWER FACTOR CORRECTOR

BACKGROUND OF THE INVENTION

The present invention relates to a power factor corrector and, more particularly, to a circuit for correcting the power factor of an alternating current signal to be applied to an AC load, most typically a capacitive load.

The term "power factor" is used to distinguish between the real and apparent power drawn by a load. Where a voltage is applied across a resistive load the current varies in accordance with the voltage and the real power is the same as the apparent power. However, where, for example, voltage is applied across a capacitive load, such as capacitive input filter of power supplies, the current does not vary in the same manner. Rather, the current flow may be characterized by a sharp pulse during each portion of the voltage half cycle, resulting in high peak currents instead of the current being distributed more evenly over the period of the input voltage waveform. The disadvantages of such high peak currents is well known to those of ordinary skill in the art and will not be described in detail at this point. In general, such high peak currents result in conditions of high peak power requirements disproportionate to the total power delivered. Such high peak power requirements impose undesirable requirements upon the power supply company and may even cause dangerous conditions within the power supply circuit.

A number of power factor correction circuits have been previously proposed and are in current use. One of the most common methods of improving the power factor of the circuit is to incorporate inductive filters into the input circuit. In some cases contemporary circuits utilize tuned filters or resonant energy storage systems, which use passive components such as inductors and capacitors to trap the higher order harmonics to reshape the input current waveform to approximate that of the a pure sine wave. Such circuits advantageously do not require active components. However, they typically require large and heavy components and/or are characterized by additional losses associated with circulating current in resonant circuits. Moreover, such circuits are typically frequency sensitive and are limited in their tolerance of inductive loads, such as fans or blowers.

Another contemporary technique for power factor correction uses active circuitry to convert the AC input to a DC voltage, which may be outputed as a regulated DC power supply or may be modulated in accordance with the AC voltage waveform. Such circuits are commonly current controlled and programmed to draw current from the AC line in almost pure sine wave. Circuits of this type find common application as an integral portion of a regulated DC power supply. Some of the disadvantages associated with such circuits includes lower reliability, due to the use of active elements and the requirements that the active elements handle all of the throughput power of the system. In addition, the high frequency switching utilized in such circuits may produce EMI emissions that require additional filtering. Losses associated with such systems and the requirement to utilize expensive high frequency switching components further limit the suitability of circuits of this type for many applications.

Accordingly, there is a need for a reliable power factor correction system which utilizes a minimum of active circuitry to reduce input current distortion and is useful to accommodate different input signals. Preferably such a system should produced an AC output that may be used to drive a variety of inductive and capacitive loads, and is tolerant of frequency deviations in the input signal. The present invention is directed to a circuit and method of power factor correction which satisfies these and other requirements in an efficient and reliable system.

SUMMARY OF THE INVENTION

A method and apparatus are disclosed for correcting the power factor of an input alternating current signal. The invention is adapted to generating an AC output signal connectable to one or more loads, such as capacitive loads. The circuit includes an energy storage inductor connected in series between the input and output terminals. A short circuit path is provided to connect output terminals during a portion of each half cycle of the AC input voltage waveform. The portion corresponds to the time necessary for the inductor to reach a level substantially corresponding to the peak level of current through the inductor when the short circuit path is disabled. In the preferred embodiment the enablement of the short circuit path between output terminals corresponds with the time commencing at the time the input voltage waveform crosses the zero reference value, and ending at a time at which the AC output voltage exceeds the input voltage.

Control circuitry for enabling and disabling the short circuit path includes an AC zero crossing detector connected across the input terminals for generating an enable signal when the input voltage waveform crosses the zero level. A first current sensor is provided for sensing the current through the short circuit path. A second current sensor is provided for sensing the current to the circuit when a load is applied to the output terminals. A peak hold circuit is connected to the second current sensor for storing the peak value of load current measured by the second current sensor. A comparator is placed in electrical communication with the peak hold circuit and the first current sensor to compare signals representative of the peak load current and the current flowing through the short circuit path. When the compared signals reach a predetermined relationship, e.g. when they are substantially equal, the comparator generates an enable signal. Switch drive logic is connected to the comparator and the AC zero crossing detector for enabling such short circuit path in response to an enable signal from the AC zero crossing detector and disabling the short circuit path in response to a disable signal from the comparator.

DETAILED DESCRIPTION OF THE PRESENTLY PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
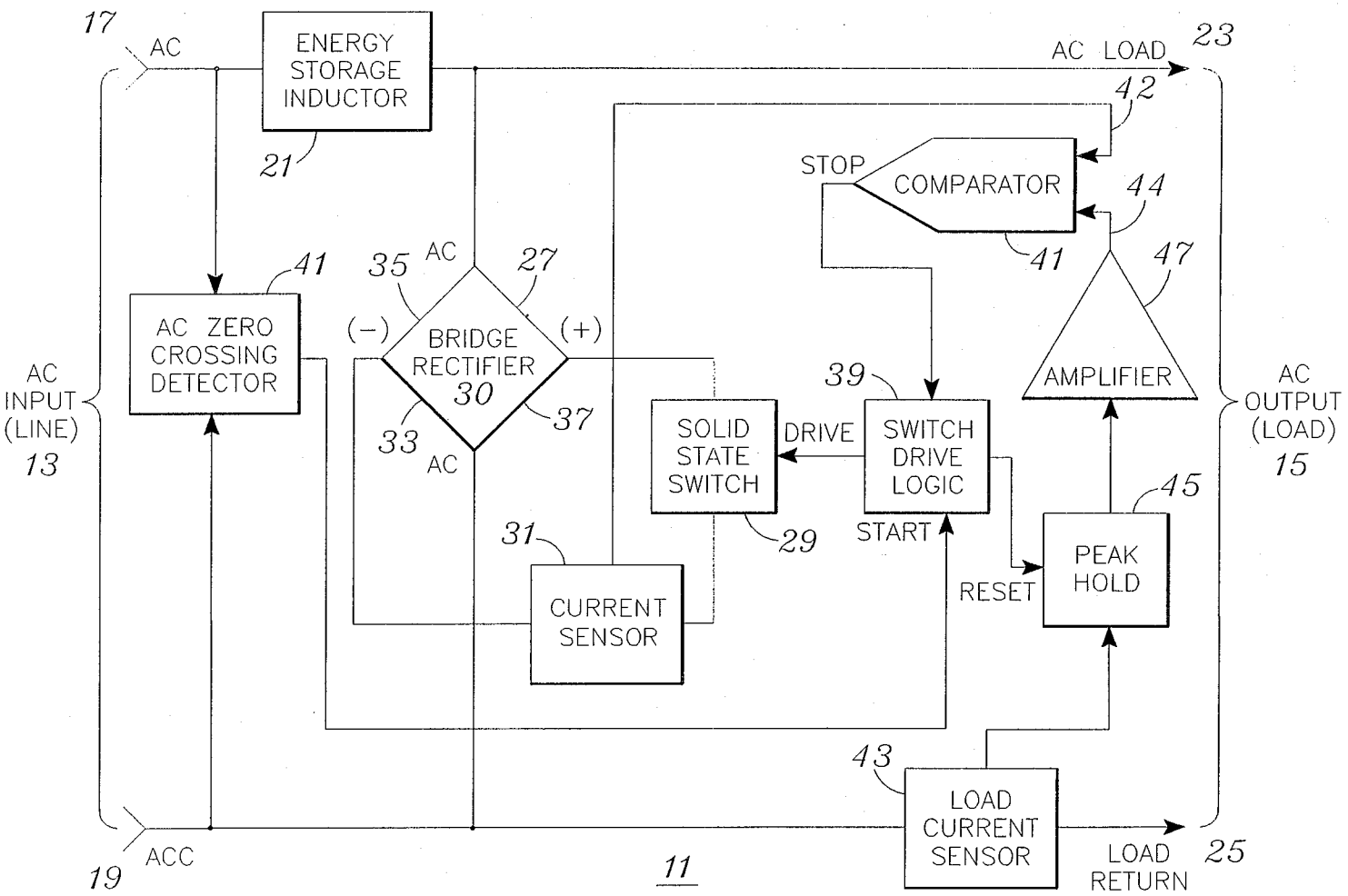
FIG. 1 is a block diagram illustrating an exemplary circuit constructed in accordance with the present invention.

FIG. 1 illustrates a functional block diagram of an exemplary circuit incorporating the novel aspects of the present invention. An overview of the operation of the circuit set forth at FIG. 1 is provided below, followed by a more detailed description of the signals generated at various portions of the circuit.

Referring to FIG. 1, the exemplary circuit 11 is adapted for connection to a standard AC line 13, commonly 120 volts at a frequency of 60 Hz. As described in more detail below the circuit 11 may advantageously be utilized, without modification, in connection with AC lines that exhibit the typical variations in frequency and voltage levels that are commonly encountered in standard AC lines. The circuit may be further adapted for use in conjunction with widely disparate voltage and frequency levels by modification of the size of illustrated components. It is, therefore, to be understood that the broader aspects of the invention are not limited to application with a single voltage and/or frequency level, reference to which is made only for purposes of describing the illustrated embodiment.

The circuit output 15 is an AC signal (illustrated at FIG. 2*b*) which is suitable to drive a variety of loads. Though the invention finds principal application in connection with capacitive loads, it is not limited to such loads. Indeed, the circuit is useful to drive inductive loads, such as fans or blowers, so long as the overall system load remains capacitive. Thus, the present invention is adaptable for use in conjunction with different types of loads having different capacitive and inductive characteristics.

In operation the AC input signal to circuit 11 is applied to input terminals 17 and 19. Input terminal 17 may be referred to as the "hot" line terminal and terminal 19 as the AC "common" line terminal. It is to be understood, however, that the broader aspects of the invention are not dependent upon the respective designations of terminal 17 and 19.

The AC input signal from terminal 17 is applied to energy storage inductor 21, which is implemented as a coil adapted to charge to a particular value upon receipt of the input signal. The remaining portion of the circuit 11 generally operates to regulate the charging and discharging of energy storage inductor 21 by selectively effecting a circuit path that shorts the AC load. No AC output signal is provided at output terminals 23, 25 when the short circuit is enabled. The purpose of selectively enabling and disabling the short circuit path is to permit the energy storage inductor to charge and discharge, thereby providing an AC input current signal which commences at a time closer to the leading edge of the AC input voltage, resulting in a more distributed current waveform and therefore higher power factor correction.

When the short circuit path is enabled the AC input signal flows through energy storage inductor 21 and is communicated to the AC common line 19 through portion 27 of bridge rectifier 30, solid state switch 29, current sensor 31 and through portion 33 of bridge rectifier 30, to the AC common line terminal 19. During the negative portion of the AC voltage input cycle the current through energy storage inductor 21 may be shorted to AC common terminal 19 through portion 35 of bridge rectifier 30, current sensor 31, solid state switch 29 and through portion 37 of bridge rectifier 30 to the AC common line terminal 19. During both the positive and negative portions of the AC input voltage waveform the path through bridge rectifier 30 is enabled only during a portion of each half cycle.

The path through bridge rectifier 30 is enabled or disabled by the operation of control circuitry including switch drive logic 39, comparator 41, load current sensor 43, peak hold circuit 45, amplifier 47 and AC zero cross detector 49. The short circuit path is enabled when switch drive logic 39 receives a START, or enable signal from AC zero crossing dectector 41, as the AC input voltage signal at line 13 crosses the zero level. Switch drive logic 39 operates to disable the short circuit path through bridge rectifier 30 when the current through bridge rectifier 30 equals or exceeds a predetermined threshold value presented to comparator 41. At that point a STOP, or disable signal is communicated to switch drive logic 39,which in turn disables solid state switch 29, thus removing the short circuit path and discharging the energy storage inductor 21 to the AC output load 15.

Figures 2A, 2B, 2C, 2D, 2E, 2F, 2G:
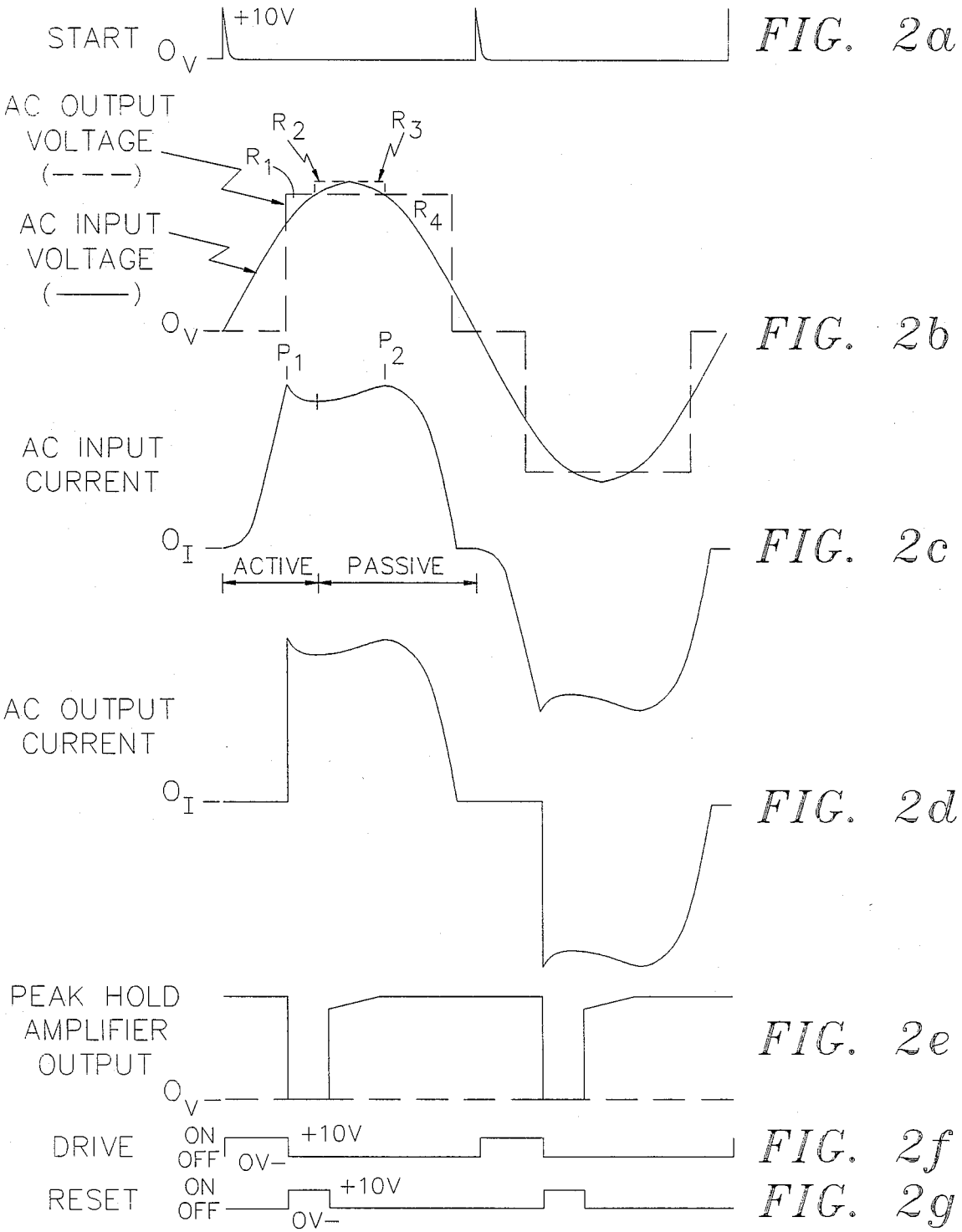
FIGS. 2*a–g* are timing diagrams illustrating signals at various portions of the circuit set forth at FIG. 1.

Referring to FIGS. 1, 2*b* and 2*c*, current sensor 31 operates to generate a voltage level proportional to the current flowing through the short circuit path, which level is used as a basis to determine whether the short circuit path should be disabled. The voltage level generated by current sensor 31 is presented at input 42 of comparator 41. The reference of threshold level against which the signal from current sensor 31 is compared is a signal representative of the peak input current value $P_2$ when the short circuit path is disabled. When those two levels are substantially equal the input current charging the inductor 21 has reached the maximum value $P_1$ that it can reach without reducing the peak current level $P_2$ when the circuit is disabled. At that point the comparator 41, switch drive logic 39 and solid state switch 29 operate to disable the short circuit path (and thereby commence discharge of energy storage inductor 21). The circuit 11 thus operates to bring the input current to a first peak value $P_1$ at a time which more closely follows the leading edge of the AC input voltage. Consequently, the circuit 11 operates to advance the leading edge of the AC input current waveform, and to distribute that waveform over each half cycle, to provide a high degree of power factor correction regardless of the applied load. With the short circuit path disabled the input current will initially decrease as the inductor 21 discharges across the load. Once the AC input voltage exceeds the AC output voltage the input current again increases to a second peak value, $P_2$ corresponding to the crossover point before the AC input voltage becomes less than the AC output voltage. Load current sensor 43 and peak hold circuit 45 cooperate to recognize and hold that second peak value which, after suitable scaling by amplifier 47, forms the reference level presented to input terminal 44 of comparator 41. Thus, a signal representative of the peak value $P_2$ from a previous cycle is fed back to serve as a reference level to cut off the initial charging of energy storage inductor 21. The resulting AC input current waveform is therefore distributed by introducing an added component representative of the conductive state of the short circuit path and the resulting discharge of inductor 21 (collectively referred to as the active component), followed by a component (referred to as the passive component) representative of the remaining open circuit state of the short circuit path. The combined active and passive components of the input current waveform produce not only an AC output but also an input current waveform that is substantially in phase with the input voltage waveform, and is characterized by a high power factor.

FIGS. 2*a*-*g* represent timing diagrams illustrating the shape and occurence of the various signals produced by the circuitry set forth in FIG. 1. FIG. 2*a* illustrates the START signal produced by AC zero crossing dectector 41 in response to the presence of the AC input voltage signal, shown at FIG. 2*b*, across input terminals 17, 19. The START signal is communicated to switch drive logic 39 and results in the generation of a drive signal shown at FIG. 2*f*, which enables the operation of solid state switch 29.

FIG. 2*b* illustrates the AC output voltage across terminals 23, 25, in relation to the AC input voltage across terminals 17, 19. As further described below the AC output voltage remains at the zero level until the short circuit path is disabled and the energy storage inductor 21 begins to discharge. At that time the AC output voltage rises to a peak level and remains at that level until the energy storage inductor 21 is completely discharged. The same pattern repeats during the negative half cycle. It is to be understood that the AC output voltage waveform will vary in accordance with the applied load, and the illustrated waveform is representative of a capacitive load. However, the operation of the invention remains the same in principle despite variations in the applied load.

FIG. 2*c* illustrates the input current waveform produced by the circuit set forth at FIG. 1. As shown in FIG. 2*c* the input current waveform is characterized by a steep ramp portion leading to the peak level $P_1$, which represents a point at which the short circuit path is disabled. That steep ramp portion represents the input current drawn by the energy storage inductor 21 as it is charged during the enablement of the short circuit path. Once the short circuit path is disabled the energy storage inductor 21 begins to discharge. The rate at which the inductor 21 discharges is dependent upon factors such as size of inductor 21 and the nature of the attached load.

After the short circuit path is disabled the energy storage inductor 21 discharges to a level representative of the current level produced by the AC input voltage, i.e. when the AC input voltage exceeds the AC output voltage (see FIG. 2*b*). At that point the decrease in AC input current stops and the input current level increases to a level identified as $P_2$. The level $P_2$ is representative of the peak input current value produced by the AC input voltage with the energy storage inductor 21 in series with the AC load. $P_2$ occurs at the crossover point before the AC input voltage level falls below the AC output voltage. Subsequent to the time corresponding to $P_2$ the AC input current decreases as energy storage inductor 21 again discharges across the load. Once the AC input current reaches the zero level the AC output voltage returns to the zero level also. The sequence repeats during the negative half cycle, commencing with the generation of a new START pulse when the AC input voltage crosses the zero level.

Referring again to FIG. 2*b*, the region identified as R1 represents the time between the point at which the short circuit path is disabled and when the energy storage inductor 21 initially discharges to a level equal to the charging current level. The regions identified as R2 and R3 collectively represent the time during which the input current increases from the lowest discharge level to the level represented by $P_2$. The region R4 represents the time during which the energy storage inductor 21 discharges completely from the level $P_2$ to zero.

FIG. 2*d* represents the AC output current. The output current level remains at zero during the time that the short circuit path is enabled. When the short circuit path is disabled, at a time corresponding to $P_1$, the AC output current jumps to a peak value. Thereafter, the AC output current follows the AC input current during the remainder of the positive half cycle. During the negative half cycle the AC output current again remains at zero during the time that the short circuit path is enabled and thereafter follows the AC input current.

FIG. 2*e* illustrates the output of the peak hold amplifier 47. At time t=zero the output from amplifier 47 is set at a level corresponding to $P_2$. Once the AC input current reaches level $P_1$ the signal at the inputs 42 and 44 of comparator 41 are substantially equal and a STOP signal is generated. In response to the generation of the STOP signal switch drive logic 39 operates to turn off the drive signal to solid state switch 29, and turn on the reset signal to peak hold circuit 45. The reset signal operates to disable the peak hold circuit for a short period of time, e.g. 1.5 milliseconds, to insure that the short circuit path remains disabled following generation of the STOP signal. After the reset signal turns off the output of the peak hold amplifier 47 is permitted to rise to its previous value or to a new value, as the AC input current rises to the level $P_2$. The peak hold amplifier output remains at that level until such time as the next STOP signal is generated.

It will be understood by those of ordinary skill in the art that certain signal levels and time periods are selected for purposes of illustration and are not intended to be limiting with respect to the broader aspects of the invention. For example, in experimental testing the time during which the reset signal is active has been set to 1.5 milliseconds. However, that period may be extended or reduced so long as the short circuit path is enabled and disabled at the appropriate time. It should also be apparent that the specific relationship of the signals at comparator terminals 42 and 44 depend on the scaling effected by the combined action of current sensor 31, load current sensor 43 and amplifier 47 and the relative operative of those components may be varied. Moreover, comparator 41 may be operative to generate a STOP signal when the signals at terminals 42 and 44 are at whatever particular level corresponds to the time at which the energy storage inductors has charged to the desired level.

In accordance with the illustrated embodiment a path is selectively enabled so that the energy storage inductor 21 initially charges to a level substantially corresponding to the peak level of the AC input current when inductor 21 is connected in series with the AC load. The path is disabled at a time to permit the input AC voltage to drive the circuit for a substantial portion of each cycle,thereby retaining the AC characteristics of the output waveforms. As a consequence the AC input current waveform is distributed over a greater period of time and power factors is enhanced. Experimental results have indicated that the present invention is operative to bring the power factor up to a range of 0.94 to 0.98. It should be understood, however, that by varying the scaling of various components the relationship between $P_1$ and $P_2$ may be varied, within the limits of the circuit stability. Thus, the present invention may advantageously permit tuning the input current waveform to provide the greatest power factor correction. Functionally, the invention permits adding to the front part of the input current waveform, subtracting from the peak surge level, and filling in the last part of the input current waveform as the input current decays towards zero. As a consequence, the present invention reconstructs the input current waveform to more closely approximate a sine shape.

As can be seen from the above description the second peak current signal $P_2$, from one half cycle is stored and used in the control circuit to determine the first current peak, $P_1$, of the inductor in the following half cycle. The first current peak, $P_1$, is controlled by the operation of solid state switch 29 which is turned off when the switch current rises to the value set by the peak hold 45. By this control method the current through the energy storage inductor 21 during the passive part of the cycle is used to determine the peak inductor current, and thereby the energy stored, during the active part of the cycle. It will be noted, however, that the controlled quantity is always lagging the controlling quantity by one half cycle. The ratio of the two current peaks $P_1$ and $P_2$ can be set to any value by the circuit values and will have a direct effect on the power factor and DC bus voltage in the load.

With constant power loads such as switchmode converters the first peak, $P_1$, is typically equal to or less than the second peak, $P_2$, to avoid instability. When the first peak, $P_1$, is above the second peak, $P_2$, the system will boost the DC bus voltage above the peak AC value but would typically be unstable with constant power (negative resistance) loads.

The design variables for AC input voltage and load power, for optimum power factor, are the ratio of the active current peak to the passive current peak and the value of inductance in the energy storage inductor 21. For stability with constant power loads the first current peak, $P_1$, may be set slightly below the second peak, $P_2$, and the inductor 21 is designed to store enough energy at nominal line and load levels to fill in most of the first half of each AC input cycle. The system will the track well over wide variations of line and load conditions. However, the design values can be made to optimize a desired characteristics at a particular operating point.

As will be apparent form FIG. 2*b*, the output voltage waveform is a quasi-square wave which contains many of the frequency elements of the sine wave and, in addition to capcitive loads, can operate peripheral inductance loads such as blowers and transformers without excessive heating of those loads. In the illustrated embodiment the RMS output voltage is approximately four percent (4%) higher than the RMS input voltage. The output current waveform is spread over a longer conduction period, thereby reducing rectifier heating and capacitor ripple in the converter or other load being powered.

The invention provides a variety of advantages over contemporary devices. It removes the need for large circulating currents, and reduces sensitivity to frequency and load resulting from the incorporation of resonant circuits. The efficiency and reliability of the present invention approach that of passive methods, because the active power elements only handle a part of the total throughput power. Because the invention utilizes the additional energy storage in the inductor, the DC buss voltage in a connected convertor to be powered may be close to the AC value, and can exceed that value by circuit adjustment. The energy content of EMI and RFI emissions is low because of the operation at line frequency. Because the output is an AC signal the circuit can be used as a stand-alone unit to power several AC loads, such as power convertors, in a system. The active elements are protected from power line transients because of the low frequency inductor 21. Large snubber capacitors may also be used due to the low frequency switching.

As will be apparent to those of ordinary skill in the art the specific circuitry selected to perform the functions of the modules identified at FIG. 1 is largely a matter of design choice in view of the above-referenced functions. As a circuit has been experimentally implemented the switch drive logic 39 incorporates a flip-flop which drives the gate of a power MOSFET which forms a portion of the solid state switch 29. The power MOSFET may, for example, be an IXYS20N50 MOSFET manufactured by IXYS Corp., or an IRF450 MOSFET manufactured by International Rectifier Corp. Alternatively, solid state switch 29 could be implemented as a bipolar transistor. In the presently preferred embodiment the bridge rectifier 30 may be implemented as a Model KCBR 3560 manufactured by General Instruments. Energy storage inductor 21 is implemented as a coil having an inductance of 8 millihenries on a sufficiently large core to prevent saturation at peak power levels. It has been found that such an inductance is suitable to operate over the normal AC input line range. Where the input voltage is increased, for example from 120 volts to 240 volts, the inductance is preferably increased by a multiple of 4, assuming the load power remains the same.

What is claimed is:

1. A power factor correction circuit connectable to receive an AC input waveform across a pair of input terminals and to communicate an AC output waveform across a pair of output terminals, said output terminals being connectable to a load, the circuit comprising:

an energy storage inductor having an input connected to one of the AC input terminals and an output connected to one of the output terminals;

a short circuit path connecting the output terminals; and control circuitry for selectively enabling the short circuit path during a portion of each half cycle of the AC input voltage waveform.

2. The circuit as recited in claim 1 wherein said portion commences at the time the input voltage waveform crosses a zero reference value and ends at the time the current through said inductor reaches a level substantially corresponding to the peak current through the inductor with the short circuit path disabled and a load connected to the output terminals.

3. The circuit as recited in claim 1 wherein said portion commences at the time the input voltage waveform crosses a zero reference value and ends at a point corresponding to the time at which the AC output voltage exceeds the AC input voltage.

4. The circuit as recited in claim 3 wherein the control circuitry comprises an AC zero crossing detector connected across the input terminals for generating an enable signal as the input waveform crosses a zero level.

5. The circuit as recited in claim 4 wherein said control circuitry further comprises:

first current sensor for sensing the current through the short circuit path;

a second current sensor for sensing the current through the circuit when a load is applied to the output terminals.

a peak hold circuit connected to said second current sensor for storing a peak current value measured by said second current sensor;

a comparator in electrical communication with said first current sensor and said peak hold circuit for comparing signals representative of the current passing through said short circuit path and the peak current value stored in the peak hold circuit, said comparator being operative to generate a short circuit disable signal when said compared signals are substantially equal; and switch drive logic connected to said comparator and said AC zero crossing detector for enabling the short circuit path in response to said enable signal and for disabling the short circuit path in response to said disable signal portion of each half cycle.

6. The circuit as recited in claim 5 wherein switch drive logic is further operative to generate a reset signal to reset an output of the peak hold circuit at a zero level in response to said disable signal.

7. The circuit as recited in claim 6 wherein the output terminals are connected to a capacitive load.

8. The circuit as recited in claim 7 wherein the output voltage waveform is a quasi-square wave.

9. A power factor correction circuit connectable to receive an AC input waveform across a pair of input terminals and to communicate an AC output waveform across a pair of output terminals, said output terminals being connectable to a load, the circuit comprising:

an energy storage inductor having an input connected to one of the AC input terminals and an output connected to one of the output terminals;

short circuit path enabling means for enabling a path connecting first and second output terminals during a portion of each half cycle of the AC input waveform, said portion corresponding to the time necessary for the current through the inductor to reach a level substantially corresponding to the peak level of current through the inductor with the short circuit path is disabled.

10. A power factor correction circuit connectable to receive an AC input waveform across a pair of input terminals and to communicate an AC output waveform across a pair of output terminals, said output terminals being connectable to a load, the circuit comprising:

an energy storage inductor having an input connected to one of the input terminals and an output connected to one of the output terminals;

a comparator circuit for comparing the input current passing through the energy storage inductor to a preset current value, said preset current value substantially corresponding to the peak level of the AC line current produced when a load is connected to the output terminals;

a switching means for selectively connecting the output terminals to effectively short the load and charge the energy storage inductor, said switching means being effective to short the load during a portion of each half cycle of the AC input waveform, said portion substantially corresponding to the time necessary for the current through said energy storage inductor to reach said preset circuit value, whereupon said shorting path is disabled.

11. A method of improving the power factor of an AC input signal applied to an AC load, the method comprising:

connecting an energy storage inductor to a first of two AC line input terminals and a first of two AC line output terminals;

connecting a load to the AC output terminals; and selectively enabling a short circuit path between the AC output terminals during a limited portion of each half cycle of the AC input signal.

12. The method as recited in claim 11 wherein said limited portion corresponds to the time necessary for the current through the energy storage inductor to increase from a zero level to a level substantially equal to the peak level of current through said inductor with a load connected to the output terminal and the short circuit path disabled.

13. A method of improving the power factor of an AC input signal applied to an AC load, the method comprising:

connecting an energy storage inductor to a first of two AC line input terminals and a first of two AC line output terminals;

connecting a load to the AC output terminals; and selectively enabling a short circuit path between the AC output terminals during a limited portion of each half cycle of AC input signal, said limited portion commencing at the time the input voltage waveform is at a zero level and ending at a time corresponding to when AC output voltage exceeds AC input voltage.

14. The method as recited in claim 13 wherein the step of selectively enabling a short circuit path comprises:

detecting when the AC input voltage waveform is at a zero level;

sensing the current through the short circuit path;

sensing the current communicated to the load;

storing a peak value of current communicated to the load;

comparing said stored current level with the level of current through the short circuit path;

enabling said short circuit path when said AC input voltage waveform is at a zero level; and disabling said short circuit path when the current through said short circuit path substantially equals said stored current level.

15. The method as recited in claim 14 further comprising the step of resetting the stored current value to zero at the time the short circuit is disabled.

* * * * *

UNITED STATES PATENT AND TRADEMARK OFFICE

CERTIFICATE OF CORRECTION

PATENT NO. : 4,876,497

DATED : October 24, 1989

INVENTOR(S) : Frank Colver

It is certified that error appears in the above—identified patent and that said Letters Patent is hereby corrected as shown below:

Col. 4, line 32, please change "of" to --or--.
Col. 6, line 54, please change "inductors" to --inductor--.
Col. 6, line 65, please change "factors" to --factor--.
Col. 7, line 45, please change "the" to --then--.
Col. 7, line 48, please change "characteristics" to --characteristic--.
Col. 7, line 49, please change "form" to --from--.
Col. 7, line 52, please change "inductance" to --inductive--.
Col. 9, line 5, please delete the period after "terminals" and insert therefore --;--.
Col. 9, line 46, after the word "path" please delete --is--.
Col. 10, line 59, after the word "circuit" please insert --path--.

Signed and Sealed this

Twenty-fifth Day of September, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,876,497

DATED : october 24, 1989

INVENTOR(S) : Frank Colver

It is certified that error appears in the above-identified patent and that said Letters Patent is hereby corrected as shown below:

The title page showing the illustrative figure should be deleted to be replaced with the attached title page.

Signed and Sealed this

Twenty-fifth Day of February, 1992

*Attest:*

HARRY F. MANBECK, JR.

*Attesting Officer*

*Commissioner of Patents and Trademarks*

United States Patent [19]

Colver

[11] Patent Number: 4,876,497

[45] Date of Patent: Oct. 24, 1989

[54] POWER FACTOR CORRECTOR

[75] Inventor: Frank Colver, Costa Mesa, Calif.

[73] Assignee: HC Power, Inc., Santa Ana, Calif.

[21] Appl. No.: 247,039

[22] Filed: Sep. 20, 1988

[51] Int. Cl.[4] ..... G05F 1/70

[52] U.S. Cl. ..... 323/211; 323/222; 323/319

[58] Field of Search ..... 363/126; 323/205, 209, 323/210, 211, 222, 235, 319

[56] References Cited

U.S. PATENT DOCUMENTS

| | | | |
|---|---|---|---|
| 4,193,111 | 3/1980 | Wester | 323/211 X |
| 4,384,321 | 5/1983 | Rippel | 323/222 X |
| 4,683,529 | 7/1987 | Bucher, II | 323/207 X |
| 4,688,162 | 8/1987 | Hutch et al. | 323/222 X |

FOREIGN PATENT DOCUMENTS

| | | | |
|---|---|---|---|
| 0169673 | 1/1986 | European Pat. Off. | 323/205 |

*Primary Examiner*—Peter S. Wong

*Assistant Examiner*—Kristine Peckman

*Attorney, Agent, or Firm*—Stetina and Brunda

[57] ABSTRACT

A method and apparatus are disclosed for correcting the power factor of an input alternating current signal. The invention is adapted to generating an AC output signal connectable to one or more loads, such as capacitive loads. The circuit includes an energy storage inductor connected in series between the input and output terminals. A short circuit path is provided to connect output terminals during a portion of each half cycle of the AC input voltage waveform. The portion corresponds to the time necessary for the inductor to reach a level substantially corresponding to the peak level of current through the inductor when the short circuit path is disabled. In the preferred embodiment the enablement of the short circuit path between ouput terminals commences at the time the input voltage waveform crosses the zero reference value, and ends at a time at which the AC output voltage exceeds the input voltage.

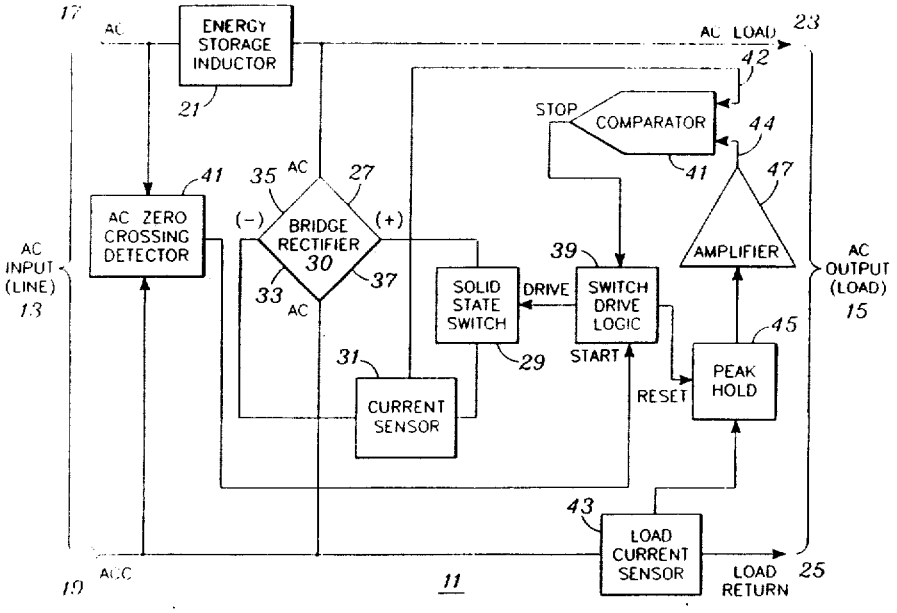

15 Claims, 2 Drawing Sheets